US008353120B2

(12) United States Patent
Burns

(10) Patent No.: US 8,353,120 B2
(45) Date of Patent: Jan. 15, 2013

(54) RETRACTABLE AND EXTENDABLE DISPLAY APPARATUS

(75) Inventor: Scott Christopher Burns, Brookfield, WI (US)

(73) Assignee: Precision Color Graphics, Ltd., Franklin, WI (US)

( * ) Notice: Subject to any disclaimer, the term of this patent is extended or adjusted under 35 U.S.C. 154(b) by 441 days.

(21) Appl. No.: 12/655,296

(22) Filed: Dec. 29, 2009

(65) Prior Publication Data

US 2011/0154702 A1 Jun. 30, 2011

(51) Int. Cl.
*G09F 11/00* (2006.01)

(52) U.S. Cl. ..... 40/486; 40/489; 40/491

(58) Field of Classification Search ..... 40/486, 40/488, 490, 491; 49/374, 404; 248/206.5, 248/298.1

See application file for complete search history.

(56) References Cited

U.S. PATENT DOCUMENTS

| | | | | |
|---|---|---|---|---|
| 5,873,205 | A * | 2/1999 | Hanlon et al. | 52/239 |
| 6,953,177 | B2 * | 10/2005 | Holland | 248/307 |
| 7,845,101 | B2 * | 12/2010 | Padiak et al. | 40/491 |
| 2003/0005611 | A1 * | 1/2003 | Carlin | 40/491 |
| 2011/0179718 | A1 * | 7/2011 | Martin et al. | 49/413 |

* cited by examiner

*Primary Examiner* — Casandra Davis
(74) *Attorney, Agent, or Firm* — William W. Haefliger

(57) ABSTRACT

An optionally extending or retracting display panel assembly, comprising a horizontally elongated support bracket configured for support at an upper portion of a relatively large first container, or the like, primary magnetic apparatus carried to magnetically attract the bracket toward the container, for removable bracket attachment to the container, and the display panel assembly and associated connections configured for horizontal displacement guiding by the bracket during panel extension and retraction relative to the container, while the panel remains generally vertically proximate a vertical side of the container. A counter-weight system assists panel leveling as well as extension and retraction.

9 Claims, 4 Drawing Sheets

RETRACTABLE AND EXTENDABLE DISPLAY APPARATUS

BACKGROUND OF THE INVENTION

This invention relates generally to display devices movable between selected positions, and more particularly a display panel assembly and associated means enabling its extension into visual display positions and retraction into non-display position, as for example out from between two large containers or the like extending in generally side-by-side, gap separated relation.

There is need for simple, compact, easily manipulable, and readily storable visual display apparatus, particularly in connection with use in conjunction with large objects such as containers, refrigerators being one example. There is also need for the apparatus and its uses and results as disclosed herein.

SUMMARY OF THE INVENTION

It is a major object of the invention to provide apparatus meeting the needs referred to above, as well as needs that will be disclosed herein. Basically, the apparatus of the invention comprises optionally retracted and extended display panel, assembly that comprises:

a) a horizontally elongated support bracket configured for support at an upper portion of a relatively large first container, or the like, b) primary magnetic means carried to magnetically attract the bracket toward the container, for bracket removable attachment to the container, and c) the display panel assembly and associated connection or connections configured for horizontal displacement guiding by the bracket during panel extension and retraction relative to the container, while the panel remains generally vertically extended proximate a vertical side of the container.

As will be seen the bracket has L-shape with a horizontal flange adapted to extend at the top of the container, and a vertical flange adapted to support the display panel as it extends and retracts.

It is another object to provide a counter-weight operatively connected to upper extent of the display panel to urge the panel toward retracted position during panel extension and retraction. Typically, a pulley or pulleys may be carried by at least one of the connectors, and a flexible line extending over the pulley and between a connection to the panel and the counter-weight, whereby weight exerted by the counter-weight tends to urge the panel toward retracted position.

An added object is to provide guide means operatively connected to lowermost extent of the panel to maintain that lowermost extent vertically oriented relative to uppermost extent of the panel, as during panel extension and retraction. That guide means may typically include secondary magnetic means extending horizontally and adjacent lowermost extent of the panel. In this regard, the first and second magnetic means typically comprises magnetic tape applicable to and removable from mounting structure, as will be seen.

The display panel assembly may include a generally rectangular frame to carry the display panel, and to be supported by the counter-weight as the panel is extended and retracted.

These and other objects and advantages of the invention, as well as the details of an illustrative embodiment, will be more fully understood from the following specification and drawings, in which:

DRAWING DESCRIPTION

DETAILED DESCRIPTION

Figure 1:
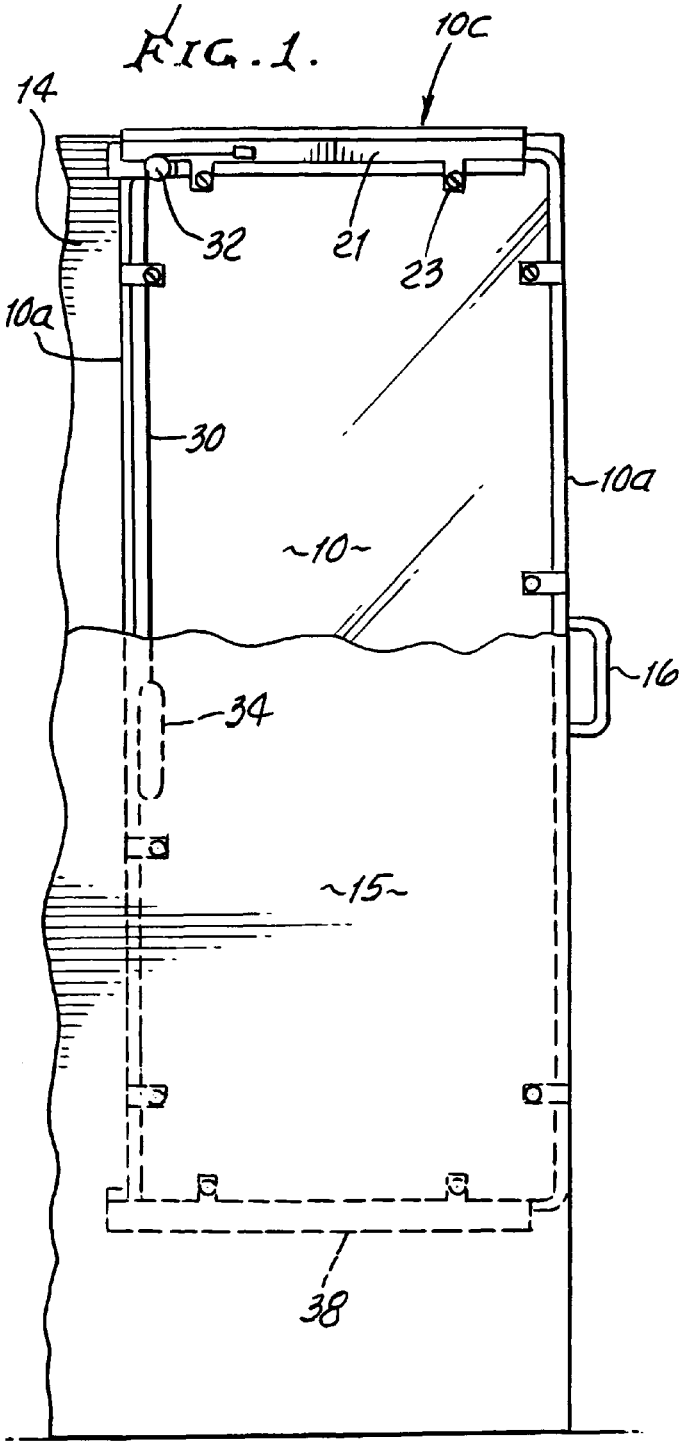
FIG. 1 is an elevation showing a display panel retracted into position between two large, generally side-by-side containers, such as refrigerators.
Figure 4:
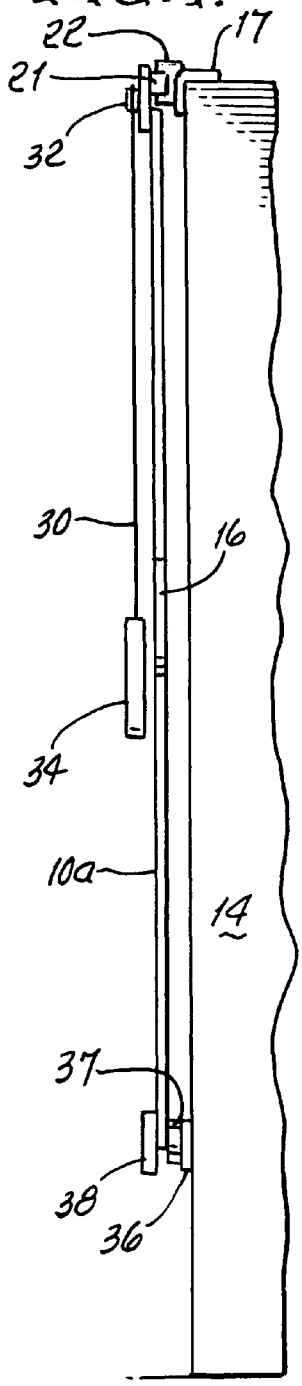
FIG. 4 is a schematic view, taken in section, to show assembly of the apparatus components.
Figure 2:
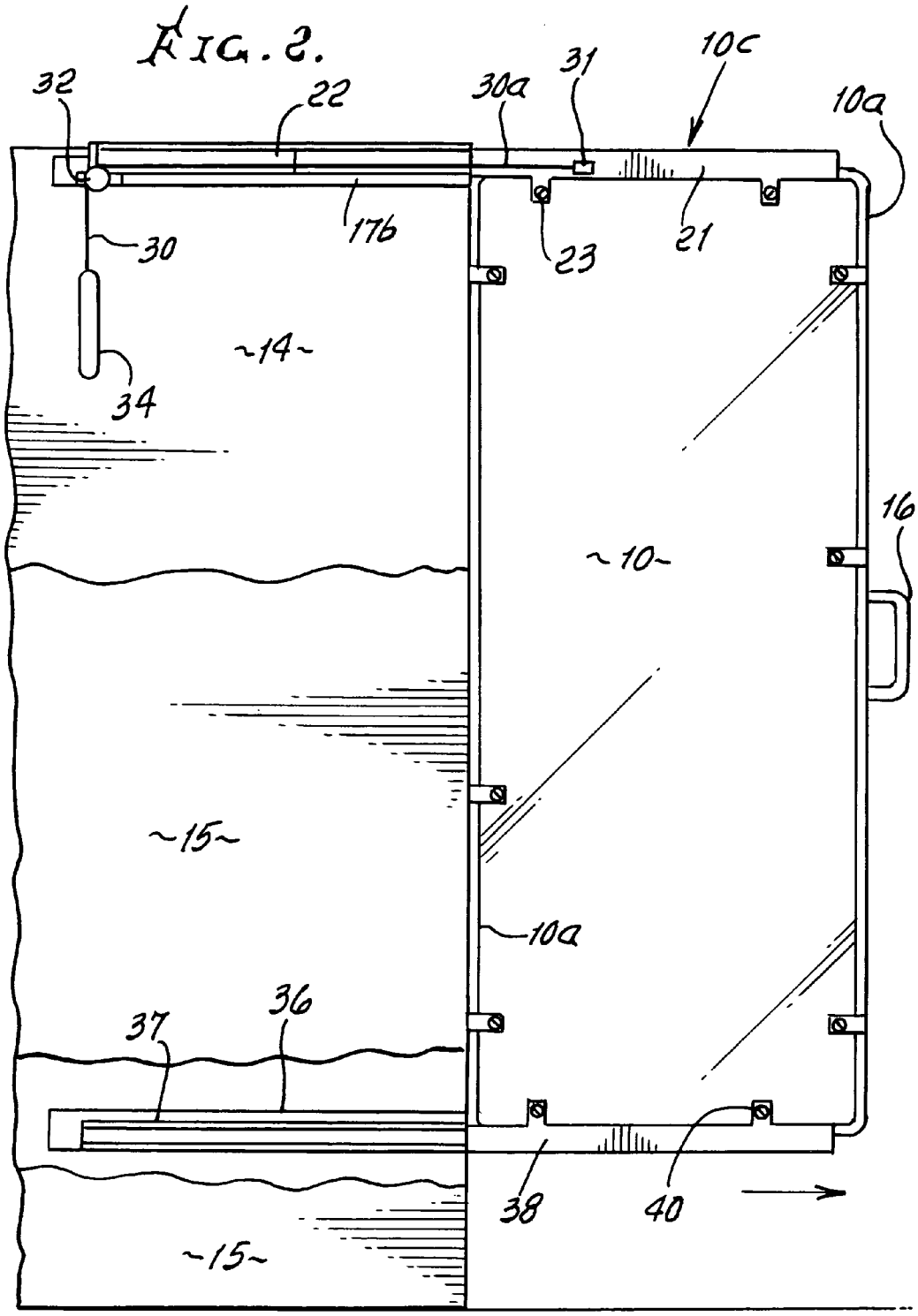
FIG. 2 is an elevation showing the display panel extended outwardly from FIG. 1 position, and in visual display position.
Figure 5:
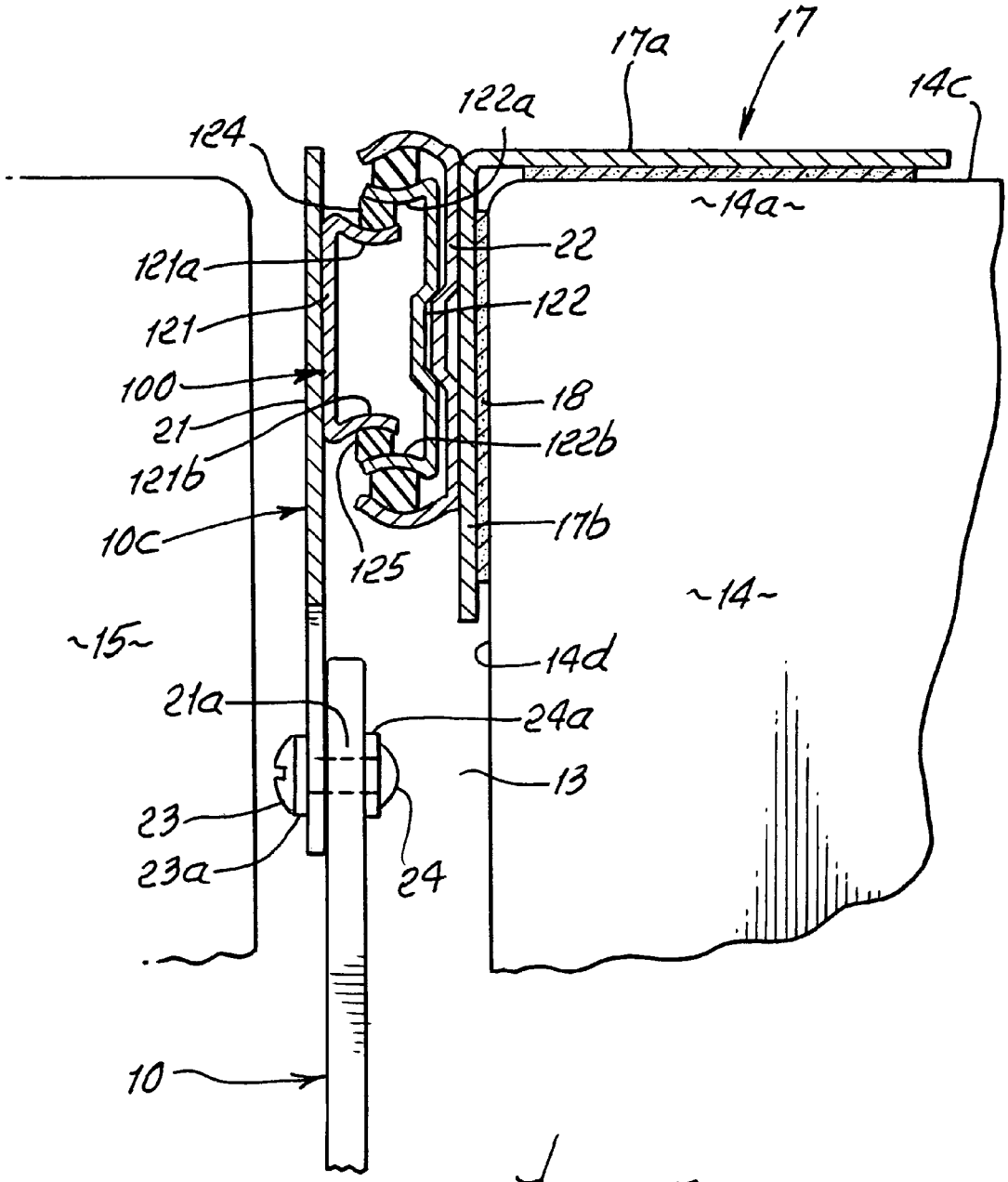
FIG. 5 is an enlarged fragmentary view showing the panel assembly and associated structure in relation to a carrier bracket on a container.

In the drawings, a display panel 10 extends vertically, and includes a rectangular frame 10*a* supporting the flat display panel. In FIG. 5 the panel is shown in horizontally retracted position in the gap 13 between two large generally side-by-side containers 14 and 15, as for example refrigerators. In FIG. 2, the panel is shown in extended position, i.e. displaced horizontally outwardly from between two containers, i.e. into visual display position. A handle 16 on the edge portion of the panel or its frame is manipulable to pull the panel outwardly into FIG. 2 display position, or to push the panel horizontally inwardly into FIG. 1 retracted position.

Figure 3:
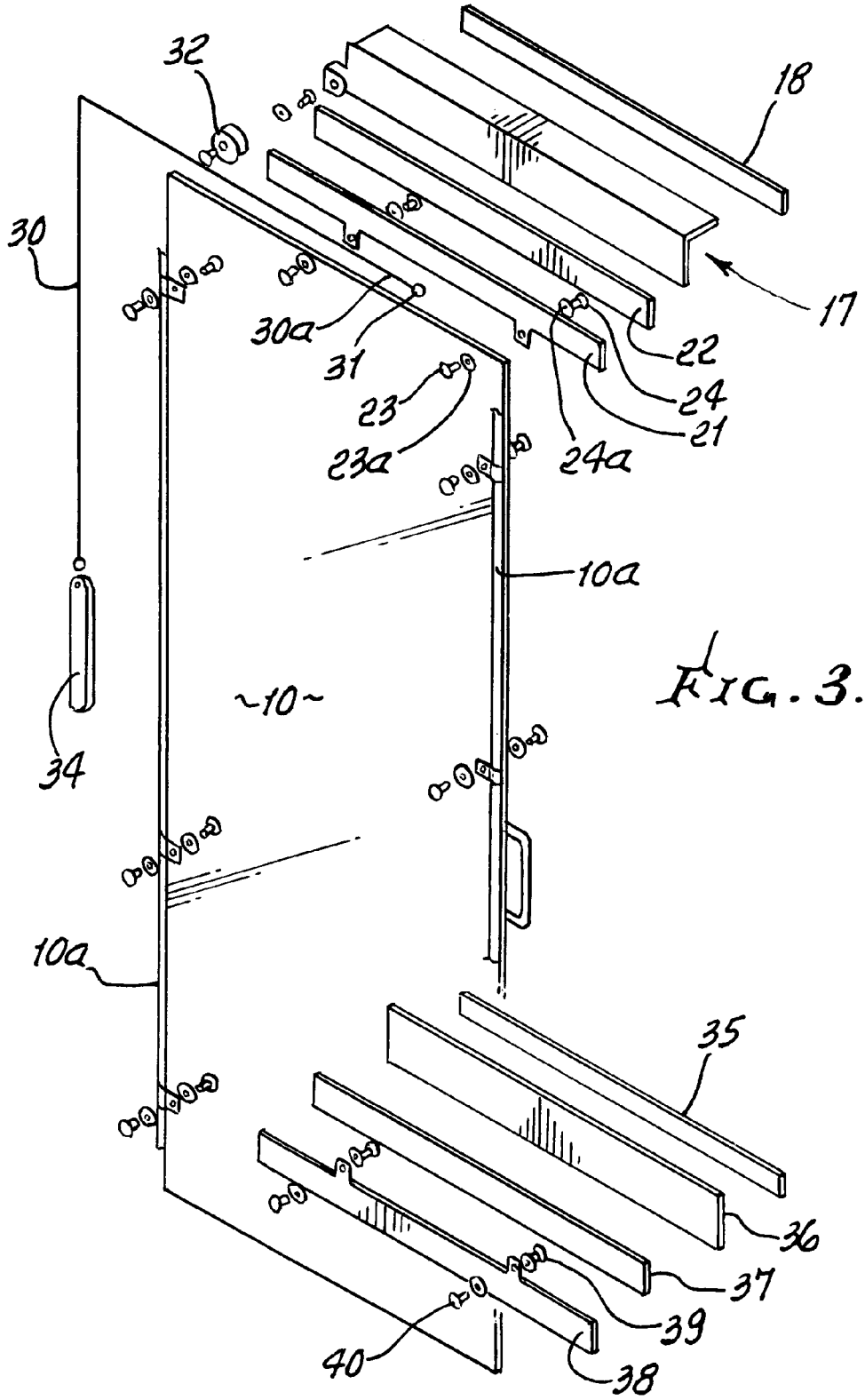
FIG. 3 is a schematic exploded view of the display panel apparatus.

FIG. 5 shows the assembly or "kit" 100 enabling ready installation and use of the panel assembly, i.e. between the two containers 14 and 15. It includes a horizontally elongated support bracket 17 configured for support at an upper portion 14*a* of a first one 14 of the already in-place containers 14 and 15, which do not need to be moved apart away from the gap 13 to accommodate to the assembly 100. The bracket 17 has a horizontal upper flange 17*a* to rest on the top edge 14*c* of the container 14, and a vertical flange 17*b* to extend proximate the side wall 14*d* of the container. A magnetic strip 18 is carried (as by adhesive) by one of the two flanges, to magnetically attract the flange to the steel wall surface of the container. Strip 18 is shown attached to vertical flange 17*b* to hold that flange closely adjacent container wall 14*d*, whereby the bracket removably closely embraces a top corner of the container, to be supported by the container. FIGS. 3 and 5 show the panel assembly 10*c* and associated connections or supports 21 and 22 configured for horizontal displacement guiding by the bracket during panel 10 extension and retraction relative to the container, while the panel remains generally vertically oriented proximate a vertical side of the container.

As shown as in FIG. 5, elongated connector 21 is in the form of an elongated strip or sub-panel attached at 21*a* to the panel 10 (or frame 10*a*), to move endwise horizontally therewith and guide such panel and frame movement between extended and retracted positions while the panel is suspended. See for example connector fasteners 23 and 24, and washers 23*a* and 24*a*, in FIG. 3.

Connector or guide plate 21 and support plate 22 slide adjacent connector 22 in the form of a low friction guide strip that may be adhered to vertical flange 17*b* of the bracket 17. Fasteners may be used to attach 22 to bracket flange 17*b*. Accordingly, as panel 10 is moved between retracted and extended positions, it is guided adjacent bracket vertical flange 17*b*, so as to precisely align with the gap 13.

Also shown is a means tending to urge the panel in retracted position, relative to the gap and the bracket. See for example, the flexible cord or line 30 having end 30*a* attached to the panel or its frame, at location 31. The line extends generally horizontally over a pulley 32 carried by the bracket 17 at 33, and then downwardly to a counter-weight 34 located inwardly of the gap. The counter-weight moves up and down as the panel moves horizontally between retracted and extended positions, urging the panel toward retracted position.

As provided, as shown in FIG. 5, are relatively solidable channel shaped members 121 and 122. Member 121 is attached to connector 21; and member 122 has flanges 122*a* and 122*b* attached to flanges of 22, and flanges 121*a* and 121*b* of 21 slide lengthwise relative to flanges 122*a* and 122*b*. Note slidable support 124 between 121*a* and 122*a*, slidable 125 support between flanges 121*b* and 122*b*. Such overhanging flanges support the panel 10 weight.

As shown in FIG. 3, secondary means including guide means is also provided and operatively connected to lowermost extent of the panel, to maintain lowermost panel assembly extent vertically oriented relative to uppermost extent of the panel during panel extension and retraction. That secondary means includes a secondary magnetic tape 35 holding a guide strip 36 adjacent lower extent of the container. A slide strip 37 is attached to 36, and a connector strip 38, attached at 39 and 40 to the panel lowermost extent, slides adjacent strip 37 as the panel slides guidedly between retracted and extended positions. The secondary member may have the detailed construction as shown in FIG. 5.

The two magnetic strips operate to assist in holding the bracket flange 17*b* rightwardly (by magnetic force) adjacent the container 14 during panel movement between retracted and extended positions.

Referring to FIG. 5, a ledge 17*b* may be provided on the bracket, to support 21 and 22, as the panel slides horizontally between extended and retracted positions.

I claim:

1. An optionally extending or retracting display panel assembly, comprising in combination:

a) a horizontally elongated support bracket configured for support at an upper portion of a relatively large first container, or the like, b) primary magnetic means carried to magnetically attract the bracket toward the container, for bracket removable attachment to the container, and c) said display panel assembly and associated connections configured for horizontal displacement guiding by the bracket during panel extension and retraction relative to the container, while the panel remains generally vertically extended proximate a vertical side of the container, d) said display panel assembly including a generally rectangular frame, and a panel carried by the frame.

2. The combination of claim 1 wherein said associated connections include a slider located between a vertical flange defined by the bracket, and uppermost extent of the panel.

3. The combination of claim 1 wherein said associated connections include two elongated channel shaped members, one member connected to the panel, and the other member connected to the bracket, the members having flanges which relatively overlaps enabling endwise relative movement.

4. An optionally extending or retracting display panel assembly, comprising in combination:

a) a horizontally elongated support bracket configured for support at an upper portion of a relatively large first container, or the like, b) primary magnetic means carried to magnetically attract the bracket toward the container, for bracket removable attachment to the container, and c) said display panel assembly and associated connections configured for horizontal displacement guiding by the bracket during panel extension and retraction relative to the container, while the panel remains generally vertically extended proximate a vertical side of the container, d) and wherein the bracket has L-shape, with a horizontal flange adapted to extend at the top of the container, and a vertical flange adapted to support the display panel as it extends and retracts.

5. An optionally extending or retracting display panel assembly, comprising in combination:

a) a horizontally elongated support bracket configured for support at an upper portion of a relatively large first container, or the like, b) primary magnetic means carried to magnetically attract the bracket toward the container, for bracket removable attachment to the container, and c) said display panel assembly and associated connections configured for horizontal displacement guiding by the bracket during panel extension and retraction relative to the container, while the panel remains generally vertically extended proximate a vertical side of the container, d) and including said first container, and a second relatively large container or the like located in such proximity to the first container that a vertical gap is defined between the first and second containers, the panel extending vertically in said gap for controlled extension from and retraction into the gap.

6. An optionally extending or retracting display panel assembly, comprising in combination:

a) a horizontally elongated support bracket configured for support at an upper portion of a relatively large first container, or the like, b) primary magnetic means carried to magnetically attract the bracket toward the container, for bracket removable attachment to the container, and c) said display panel assembly and associated connections configured for horizontal displacement guiding by the bracket during panel extension and retraction relative to the container, while the panel remains generally vertically extended proximate a vertical side of the container, d) and including a hanging counter-weight operatively connected to upper extent of the display panel to urge the panel toward retracted position.

7. An optionally extending or retracting display panel assembly, comprising in combination:

a) a horizontally elongated support bracket configured for support at an upper portion of a relatively large first container, or the like, b) primary magnetic means carried to magnetically attract the bracket toward the container, for bracket removable attachment to the container, and c) said display panel assembly and associated connections configured for horizontal displacement guiding by the bracket during panel extension and retraction relative to the container, while the panel remains generally vertically extended proximate a vertical side of the container, d) and including a hanging counter-weight operatively connected to upper extent of the display panel to urge the panel toward retracted position, e) and including a pulley carried by the bracket, and a flexible line extending over the pulley and between connections to the panel and the counter-weight, whereby weight exerted by the counter-weight tends to urge the panel toward retracted position.

8. An optionally extending or retracting display panel assembly, comprising in combination:

a) a horizontally elongated support bracket configured for support at an upper portion of a relatively large first container, or the like, b) primary magnetic means carried to magnetically attract the bracket toward the container, for bracket removable attachment to the container, and c) said display panel assembly and associated connections configured for horizontal displacement guiding by the bracket during panel extension and retraction relative to the container, while the panel remains generally vertically extended proximate a vertical side of the container, d) and including guide means operatively connected to lowermost extent of the panel to maintain said lowermost extent vertically oriented relative to uppermost extent of the panel, as during panel extension and retraction.

9. The combination of claim 8 wherein said guide means includes secondary magnetic means extending horizontally and adjacent lowermost extent of the panel.

* * * * *